US006060830A

United States Patent [19]

Sugitani et al.

[11] Patent Number: 6,060,830

[45] Date of Patent: May 9, 2000

[54] HIGH PRESSURE MERCURY LAMP

[75] Inventors: Akihiko Sugitani; Hiroto Sato, both of Himeji; Takashi Ito, Tatsuno; Yoshihiro Horikawa, Himeji, all of Japan

[73] Assignee: Ushiodenki Kabushiki Kaisha, Tokyo, Japan

[21] Appl. No.: 09/089,413

[22] Filed: Jun. 3, 1998

[30] Foreign Application Priority Data

Apr. 8, 1998 [JP] Japan ..... 10-111317

[51] Int. Cl.[7] ..... H01J 17/20

[52] U.S. Cl. ..... 313/639; 313/642; 313/571

[58] Field of Search ..... 313/639, 642, 313/571

[56] References Cited

U.S. PATENT DOCUMENTS

| | | | |
|---|---|---|---|
| 4,686,419 | 8/1987 | Block et al. | 313/639 X |
| 5,109,181 | 4/1992 | Fischer et al. | 313/639 X |
| 5,489,819 | 2/1996 | Sakai et al. | 313/639 X |
| 5,497,049 | 3/1996 | Fischer . | |

FOREIGN PATENT DOCUMENTS

| | | |
|---|---|---|
| 46-21433 | 6/1971 | Japan . |
| 49-5421 | 7/1974 | Japan . |
| 5-144413 | 6/1993 | Japan . |

*Primary Examiner*—Ashok Patel
*Attorney, Agent, or Firm*—Nixon Peabody LLP; David S. Safran

[57] ABSTRACT

A high pressure mercury lamp with an extremely high mercury vapor pressure and extremely high tube wall load in which the arc during operation is advantageously stabilized is achieved in a high pressure mercury lamp having a discharge vessel of fused silica glass which contains a pair of opposed tungsten electrodes, mercury in an amount at least equal to 0.16 mg/mm$^3$ and a rare gas, and in which the discharge tube has a tube wall load at least equal to 0.8 W/mm$^2$, by at least one metal halide with a metal having an ionization potential that is at most 0.87 times as high as the mercury ionization potential being added to the discharge tube in a range of from $2\times10^{-4}$ to $7\times10^{-2}$ $\mu$mole/mm$^3$.

4 Claims, 2 Drawing Sheets

HIGH PRESSURE MERCURY LAMP

BACKGROUND OF THE INVENTION

1. Field of the Invention

The invention relates to a high pressure mercury lamp, and especially to a high pressure mercury lamp with high radiance which is used as a light source for back lighting of a liquid crystal projector and for fiber illumination.

2. Description of Related Art

In a liquid crystal display device of the projection type there is a need for illumination of images on a rectangular screen in a uniform manner and with adequate color reproduction. Therefore, as the light source, a metal halide lamp is used which is filled with mercury and metal halides. These metal halide lamps have recently been made even smaller so that more and more they represent point light sources. Metal halide lamps with an extremely small distance between the electrodes are used in practice.

Proceeding from this background, instead of metal halide lamps, recently, lamps have been suggested with a mercury vapor pressure which is higher than ever before, for example, greater than or equal to 200 bar (roughly 197 atm). Here, by increasing the mercury vapor pressure, spreading of the arc is suppressed (concentrated), and furthermore, there is an effort to increase light intensity even more. These lamps are disclosed, for example, in Japanese patent disclosure document HEI 2-148561 and Japanese patent disclosure document HEI 6-52830.

In Japanese patent disclosure document HEI 2-148561 (U.S. Pat. No. 5,109,181) a high pressure mercury lamp is disclosed in which a discharge vessel provided with a pair of tungsten electrodes is filled with a rare gas, greater than or equal to 0.2 mg/mm$^3$ mercury, and a halogen in the range from $1\times10^{-6}$ to $1\times10^{-4}$ $\mu$mole/mm$^3$, and which is operated with a wall load of at least 1 W/mm$^2$. The reason for adding an amount of mercury of at least 0.2 mg/mm$^3$ is to improve color reproduction by increasing the mercury pressure and the continuous spectrum in the area of visible radiation, especially in the red range. The reason for a wall load of at least 1 W/mm$^2$ is the need for a temperature increase in the coolest portion in order to increase the mercury pressure. The reason for adding the halogen is to prevent blackening of the envelope; this can be taken from the publication. The reason for fixing the halogen in the range from $1\times10^{-6}$ to $1-10^{-4}$ $\mu$mole/mm$^3$ is, however, not described. Furthermore, it is also described that the halogen cannot be added in the form of a metal compound because this would etch the electrodes.

On the other hand, in Japanese patent disclosure document HEI 6-52830 (U.S. Pat. No. 5,497,049), it is described that, in addition to the above described amount of mercury, values of wall load and amount of halogen, the shape of the discharge vessel and the distance between the electrodes are fixed, and furthermore, the type of halogen is limited to bromine. The reason for adding bromine is to prevent blackening of the envelope. When at least $10^{-6}$ $\mu$mole/mm$^3$ bromine is added, a sufficient effect is obtained. It is also shown that when more than $10^{-4}$ $\mu$mole/mm$^3$ bromine is added, the electrodes are etched. Furthermore, it is described in this publication that this lamp is suitable for a projector light source and that the degree to which illuminance of the image surface of a liquid crystal projection television is maintained is better at 4000 hours than in a conventional lamp.

However, in the above described conventional lamps, it was considered disadvantageous that the arc fluctuates during lamp operation. The reason for this is not entirely clear, but the following is assumed.

Since the amount of mercury added is high, the mercury vapor pressure is extremely high. Consequently, the arc contracts and becomes very narrow. Since a large amount of power is being supplied to this narrow arc, so that a large tube wall load results, the power density in the arc is therefore extremely high and the arc temperature rises. Due to the extremely high mercury vapor pressure, the narrowness of the arc, and the extremely high temperature, the speed of convection in the arc vicinity is greatly increased. The temperature on the boundary between the arc and the peripheral area is steeply changed and as a result arc fluctuations presumably occur.

In the above described publications of the prior art, it is furthermore described that the emission of the portion of red is increased and that emission with sufficiently good color reproduction can be effected. In the case of use as the background light of a liquid crystal projector, however, it cannot be stated that the need for high color reproduction has been adequately satisfied recently. This means that there is a need for emission in which the portion of red is increased even more.

SUMMARY OF THE INVENTION

Therefore, the object of the invention is to devise a high pressure mercury lamp with an extremely high mercury vapor pressure and extremely high wall load in which the arc during operation is advantageously stabilized and emission with an increased portion of red and good color reproduction can be effected.

According to an embodiment of the invention, in a high pressure mercury lamp in which, in a discharge vessel of fused silica glass, a pair of tungsten electrodes is disposed opposite one another and at least 0.16 mg/mm$^3$ mercury and rare gas have been added, and in which the wall load is at least equal to 0.8 W/mm$^2$, the object is achieved by at least one metal halide with a metal having an ionization potential at most 0.87 times as high as the mercury ionization potential being added, in a range of $2\times10^{-4}$ to $7\times10^{-2}$ $\mu$mole/mm$^3$, in the discharge vessel.

Also, according to another embodiment of the invention, in a high pressure mercury lamp in which, in a discharge vessel of fused silica glass, a pair of tungsten electrodes are disposed opposite one another and at least 0.16 mg/mm$^3$ mercury and rare gas have been added, and in which the wall load is at least equal to 0.8 W/mm$^2$, the object is achieved by at least one metal with an ionization potential at most 0.55 times as high as the mercury ionization potential being added in a range of $1\times10^{-5}$ to $2-10^{-2}$ $\mu$mole/mm$^3$ and at least one halogen being added in a range from $2\times10^{-4}$ to $7\times10^{-2}$ $\mu$mole/mm$^3$ in the discharge vessel.

The object is furthermore achieved by at least one metal halide having emission lines in the wavelength range from 580 to 780 nm in the high pressure mercury lamp as described above.

The first embodiment of the invention has a fused silica glass discharge vessel that is filled with at least one metal halide with a metal having an ionization potential that is at most 0.87 times as high as the mercury ionization potential, that is, at least one metal which ionizes more easily than mercury, in the form of a halide in the quantitative range from $2\times10^{-4}$ to $7\times10^{-2}$ $\mu$mole/mm$^3$. When this metal is added, in an area with a relatively low temperature in the vicinity of the border area between the arc and the area outside the arc in the arc peripheral area, compared to using only mercury, ionization of this metal also occurs.

This means that power is supplied in this area as well. The temperature in the area in the vicinity of the border area between the arc and the area outside the arc therefore changes more gently in the arc peripheral area. The substantial arc diameter becomes larger. In an arc with a large diameter in which the temperature change in the boundary area between the arc and the area outside the arc is still relatively steep, but takes place more gently than in an arc with a small diameter, arc fluctuations, of course, do not frequently occur. The halogen released by the metal halide during lamp operation, furthermore, prevents blackening of the inner wall of the discharge vessel.

If, here, the added amount of metal halide is no more than $2\times10^{-4}$ $\mu$mole/mm$^3$, the effect of suppressing arc fluctuations is reduced. The reason for this is that the amount of added metal which is easily ionized in the area with a relatively low temperature in the arc peripheral area is low and that, as a result, arc fluctuations often occur. When the amount of metal halide added is greater than $7\times10^{-2}$ $\mu$mole/mm$^3$, the disadvantage arises that corrosion of the electrodes occurs.

In this case, "metal" in the invention should not be taken as a strictly defined metal, but all elements except for rare gas, halogen, carbon, nitrogen and oxygen, as are conventionally present in a metal halide lamp.

In the second embodiment of the invention, there is a limitation to a metal with a lower ionization potential than the metal of the first embodiment. The invention, in this case, is specifically characterized in that a metal is used with an ionization potential at most 0.55 times as high as the mercury ionization potential. If this metal is added in an amount of greater than or equal to $1\times10^{-5}$ $\mu$mole/mm$^3$, sufficient arc stabilization can take place. Furthermore, arc fluctuations and the devitrification of the vessel can likewise be prevented by the amount of halogen added being greater than or equal to $7\times10^{-4}$ $\mu$mole/mm$^3$.

When the amount of metal added and the amount of halogen added are each greater than $7\times10^{-2}$ $\mu$mole/mm$^3$, electrode corrosion takes place.

For example, lithium, sodium, cesium, barium, and the like can be used as the metal with an ionization potential at most 0.55 times as high as the mercury ionization potential.

In either of the noted embodiments of the invention, choosing at least one metal halide which has emission lines in the wavelength range from 580 to 680 nm enables good supplementation of emission in the vicinity of the red range. Therefore, color reproduction can be greatly improved. For example, a halide of cesium, sodium, calcium and lanthanum can be used as a metal halide of this type.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
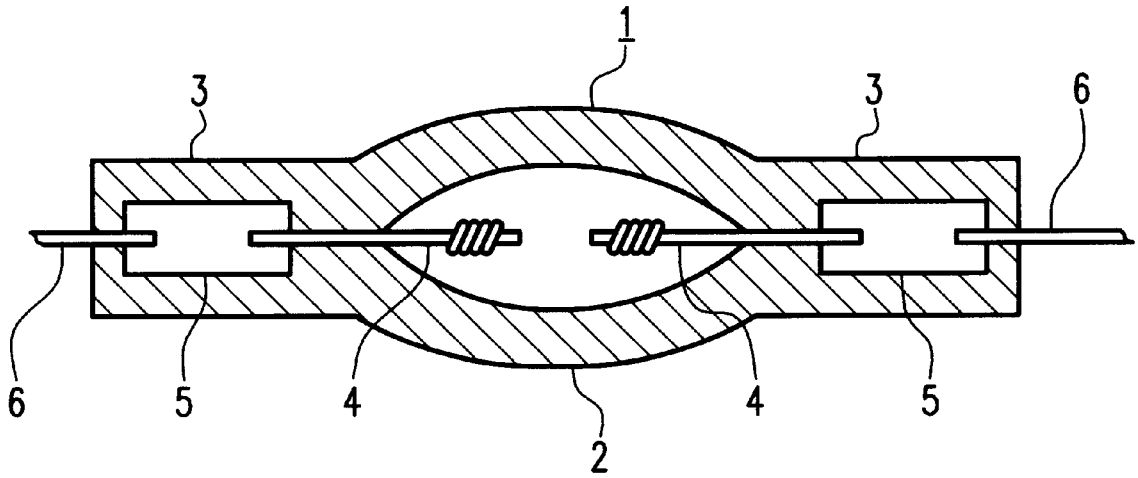
FIG. 1 shows a schematic of a high pressure mercury lamp according to the invention.

FIG. 1 schematically shows a high pressure mercury lamp in accordance with the invention. In the drawing a fused silica glass discharge lamp 1 is shown which is comprised of a discharge vessel 2 in the middle and narrow hermetically sealed portions 3 which adjoin the two ends of the discharge vessel 2. In discharge vessel 2 (hereinafter called the "emission space"), there is a pair of tungsten electrodes 4 at a distance of roughly 1.2 mm from one another. The rear (outer) ends of the electrodes 4 are inserted into hermetically sealed portions 3 and each is welded to the inner end of a respective metal foil 5. Outer leads 6 are connected to the outer ends of the metal foils 5.

The emission space contains mercury as the main emission substance and a rare gas, such as argon, xenon and the like, as the operation starting gas. This rare gas is added, for example, in an amount corresponding to 10 kPa. The amount of mercury added is at least equal to 0.22 mg/mm$^3$, by which the vapor pressure during stable operation is greater than or equal to a hundred and some dozen atm. The inside volume of the discharge vessel is, for example, 75 mm$^3$ and the wall load is 1.5 W/mm$^2$.

The discharge vessel is filled with calcium bromide ($CaBr_2$) in an amount of, for example, $3\times10^{-4}$ $\mu$mole/mm$^3$ as the emission substance. The ionization potential of this calcium is 6.1 V, which is 0.58 times as high as the ionization potential of the mercury. When this calcium bromide was added, the arc fluctuations were improved to 1/10 of the arc fluctuations in the case in which the calcium bromide was not added.

As another embodiment, the same discharge vessel 2 as described above was filled with 0.19 mg/mm$^3$ mercury, $7\times10^{-3}$ $\mu$mole/mm$^3$ sodium (Na), $3\times10^{-5}$ $\mu$mole/mm$^3$ lithium (Li), $5\times10^{-4}$ $\mu$mole/mm$^3$ bromine ($Br_2$), and 10 kPa argon (Ar). Operation was carried out with a wall load of 1.2 W/mm$^2$. Furthermore, a high pressure mercury lamp was operated for comparison purposes which contained neither sodium (Na) nor lithium (Li), with only mercury provided as the emission substance.

As a result, in the lamp without the addition of sodium (Na) and lithium (Li), unstable arc fluctuations occurred (relative fluctuations of 5 to 20%) within 10 minutes after starting of lamp operation, while in a lamp with sodium (Na) and lithium (Li) added, the arc had been stabilized, and during uninterrupted observation of several hours, the above described arc fluctuations were no longer ascertained.

Figure 2:
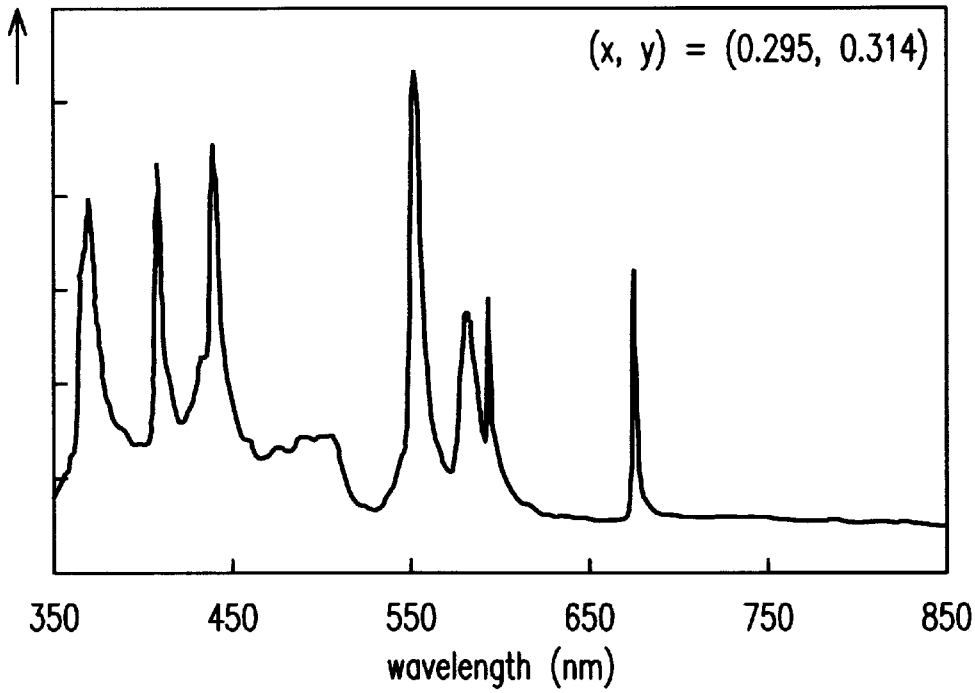
FIG. 2 shows a graph of the spectrum of a high pressure mercury lamp according to the invention.
Figure 3:
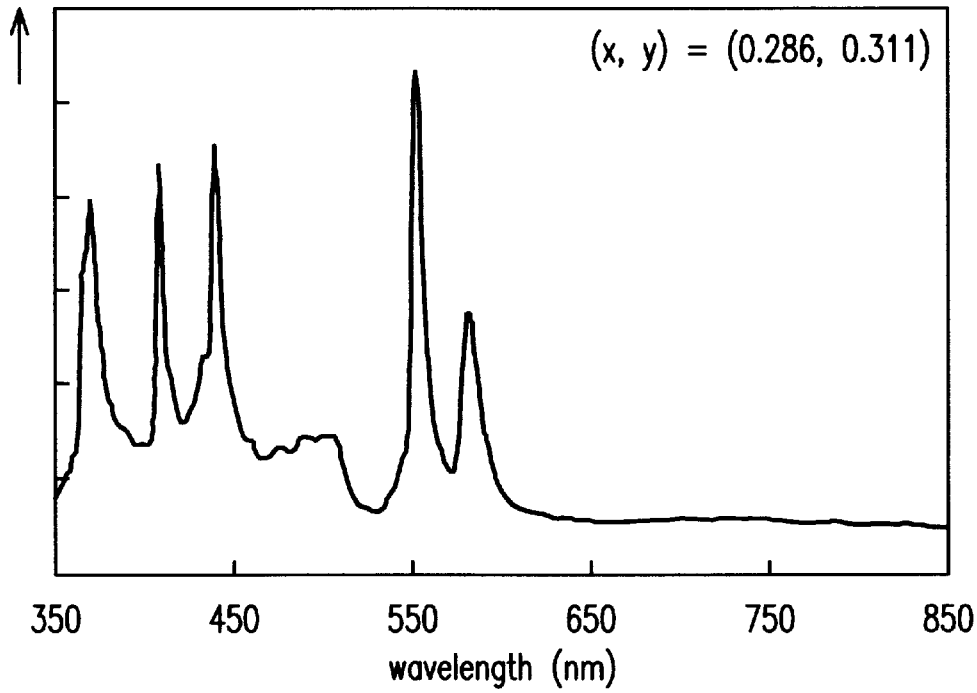
FIG. 3 shows a graph of the spectrum of a conventional high pressure mercury lamp.

FIG. 2 schematically shows the spectrum of a lamp filled with sodium (Na) and the like. FIG. 3 schematically shows the spectrum of a lamp not filled with sodium (Na) and the like. Comparison of the two figures shows that, in the lamp filled with sodium (Na) and lithium (Li), the resonance line with 589 nm of sodium and the resonance line with 671 nm of lithium (Li) are emitted extremely well. In the color coordinates of this lamp, thus x=0.295 and y=0.314. In the color coordinates of the lamp not filled with sodium (Na) and lithium (Li), x=0.286 and y=0.311. This shows that the proportion of red has been increased.

ACTION OF THE INVENTION

As was described above, in the high pressure mercury lamp in accordance with the invention in which, in a fused silica glass discharge vessel, a pair of tungsten electrodes is disposed opposite one another and the vessel is filled with at least 0.16 mg/mm$^3$ mercury and a rare gas, and in which the tube wall load is greater than or equal to 0.8 W/mm$^2$, the following effects occur:

1. In the discharge vessel, at least one metal halide with a metal having an ionization potential at most 0.87 times as high as the mercury ionization potential in the range from $2\times10^{-4}$ to $7\times10^{-2}$ $\mu$mole/mm$^3$ is added. By this feature this metal easily ionizes in an area with a relatively low temperature in the vicinity of the border area between the arc and the area outside the arc in the arc peripheral area. As a result the arc can be stabilized.

2. In the discharge vessel, at least one metal with an ionization potential that is at most 0.55 times as high as the mercury ionization potential in the range from $1\times10^{-5}$ to $2\times10^{-2}$ $\mu$mole/mm$^3$ and at least one halogen in the range from $2\times10^{-4}$ to $7\times10^{-2}$ $\mu$mole/mm$^3$ are added. By means of this feature, the ionization of this metal can take place even more easily and the arc can be stabilized.

Furthermore, by using metals, such as sodium, lithium and the like, with ionization potentials lower than the ionization potential of mercury in the wavelength range from 580 to 780 nm, strong emission of light with the red portion increased can be produced. Consequently, emission with outstanding color reproduction can be accomplished.

What we claim is:

1. A high pressure mercury lamp comprising a discharge vessel of fused silica glass containing a pair of opposed tungsten electrodes, an amount of mercury at least equal to 0.16 mg/mm$^3$ and a rare gas, the discharge vessel having a tube wall load at least equal to 0.8 W/mm$^2$; wherein at least one metal halide a metal having with an ionization potential at most 0.87 times as high as the mercury ionization potential is contained in the discharge vessel in a range of from $2\times10^{-4}$ to $7\times10^{-2}$ $\mu$mole/mm$^3$.

2. High pressure mercury lamp as claimed in claim 1, wherein the at least one metal halide has emission lines in the wavelength range from 580 to 780 nm.

3. High pressure mercury lamp comprising a discharge vessel of fused silica glass containing a pair of opposed tungsten electrodes, mercury in an amount at least equal to 0.16 mg/mm$^3$ and a rare gas, the discharge vessel having wall load at least equal to 0.8 W/mm$^2$; wherein at least one metal with an ionization potential at most 0.55 times as high as the mercury ionization potential in a range from $1\times10^{-5}$ to $2\times10^{-2}$ $\mu$mole/mm$^3$ and at least one halogen are in a range from $2\times10^{-4}$ to $7\times10^{-2}$ $\mu$mole/mmn$^3$ contained in the discharge vessel.

4. High pressure mercury lamp as claimed in claim 3, wherein the at least one metal halide has emission lines in the wavelength range from 580 to 780 nm.

* * * * *